US012533544B2

(12) United States Patent
Johnston et al.

(10) Patent No.: US 12,533,544 B2
(45) Date of Patent: Jan. 27, 2026

(54) EXERCISE APPARATUSES

(71) Applicant: ORTHOTECH SPORTS MEDICAL EQUIPMENT, INC., Herrin, IL (US)

(72) Inventors: Thomas Johnston, Kirkwood, MO (US); Jason Boogerd, Solon, IA (US)

( * ) Notice: Subject to any disclaimer, the term of this patent is extended or adjusted under 35 U.S.C. 154(b) by 156 days.

(21) Appl. No.: 18/383,843

(22) Filed: Oct. 25, 2023

(65) Prior Publication Data

US 2024/0139575 A1 May 2, 2024

Related U.S. Application Data

(60) Provisional application No. 63/420,238, filed on Oct. 28, 2022.

(51) Int. Cl.
*A63B 21/072* (2006.01)
*A63B 21/00* (2006.01)
*A63B 71/00* (2006.01)

(52) U.S. Cl.
CPC ..... *A63B 21/0724* (2013.01); *A63B 21/4035* (2015.10); *A63B 2071/0072* (2013.01)

(58) Field of Classification Search
CPC ..... A63B 21/0724
See application file for complete search history.

(56) References Cited

U.S. PATENT DOCUMENTS 4,327,908 A * 5/1982 James ..... A63B 21/0724 482/139
6,224,518 B1 * 5/2001 Weiss ..... A63B 21/078 482/106
6,676,575 B1 * 1/2004 Mayo ..... A63B 23/0211 482/148
8,951,170 B1 * 2/2015 Tayo ..... A63B 21/0728 482/139
9,138,613 B2 * 9/2015 Ferrell ..... A63B 21/078
11,235,192 B1 * 2/2022 Thomas ..... A63B 21/078
11,432,598 B1 * 9/2022 Grell ..... A63B 71/0054
D1,029,144 S * 5/2024 Larson ..... D21/679
D1,077,094 S * 5/2025 Juarez ..... D29/100
2003/0130096 A1 * 7/2003 LaCroce ..... A63B 21/0724 482/106
2014/0148852 A1 * 5/2014 Welch ..... A63B 21/045 482/121
2016/0051857 A1 * 2/2016 Rasner ..... A63B 21/4035 482/92

(Continued)

OTHER PUBLICATIONS

Rogue MG 4c Multi-Grip Camber Bar; https://www.roguefitness.com/rogue-rng-4c-multi-grip-camber-bar; web accessed Mar. 4, 2024; 9 pgs.

(Continued)

*Primary Examiner* — Joshua T Kennedy
(74) *Attorney, Agent, or Firm* — Harness, Dickey & Pierce, P.L.C.

(57) ABSTRACT

An exercise apparatus includes a grip section including at least one pair of handles; a first sleeve coupled to a first end of the grip section; and a second sleeve coupled to a second end of the grip section, which is opposite the first end. Each of the first and second sleeves is structured to receive one or more weight plates. The grip section includes a first grip segment, a second grip segment, and a platform positioned between the first grip segment and the second grip segment.

16 Claims, 9 Drawing Sheets

(56) References Cited

U.S. PATENT DOCUMENTS

Figure 1A:
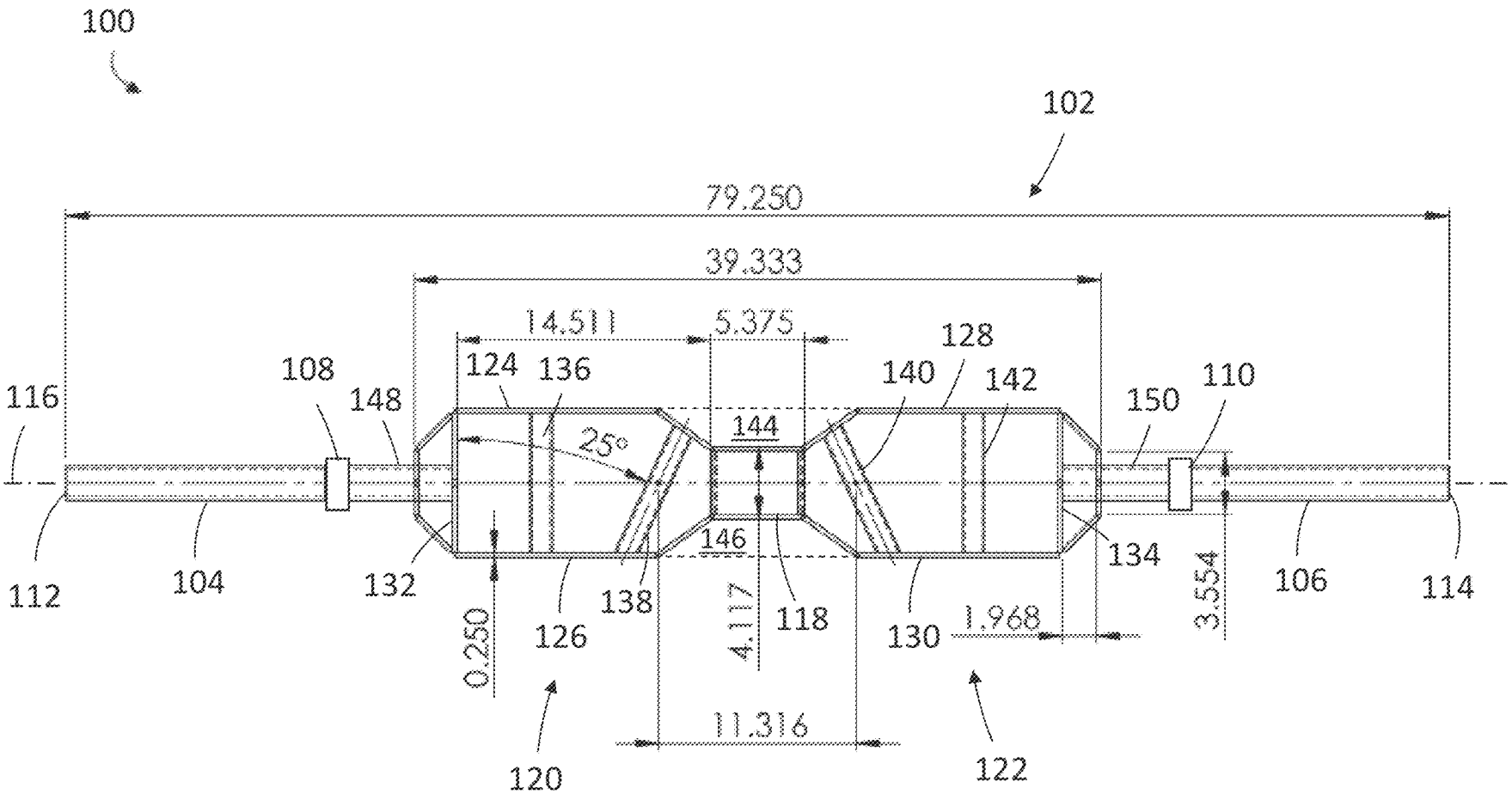
Figure 1B:
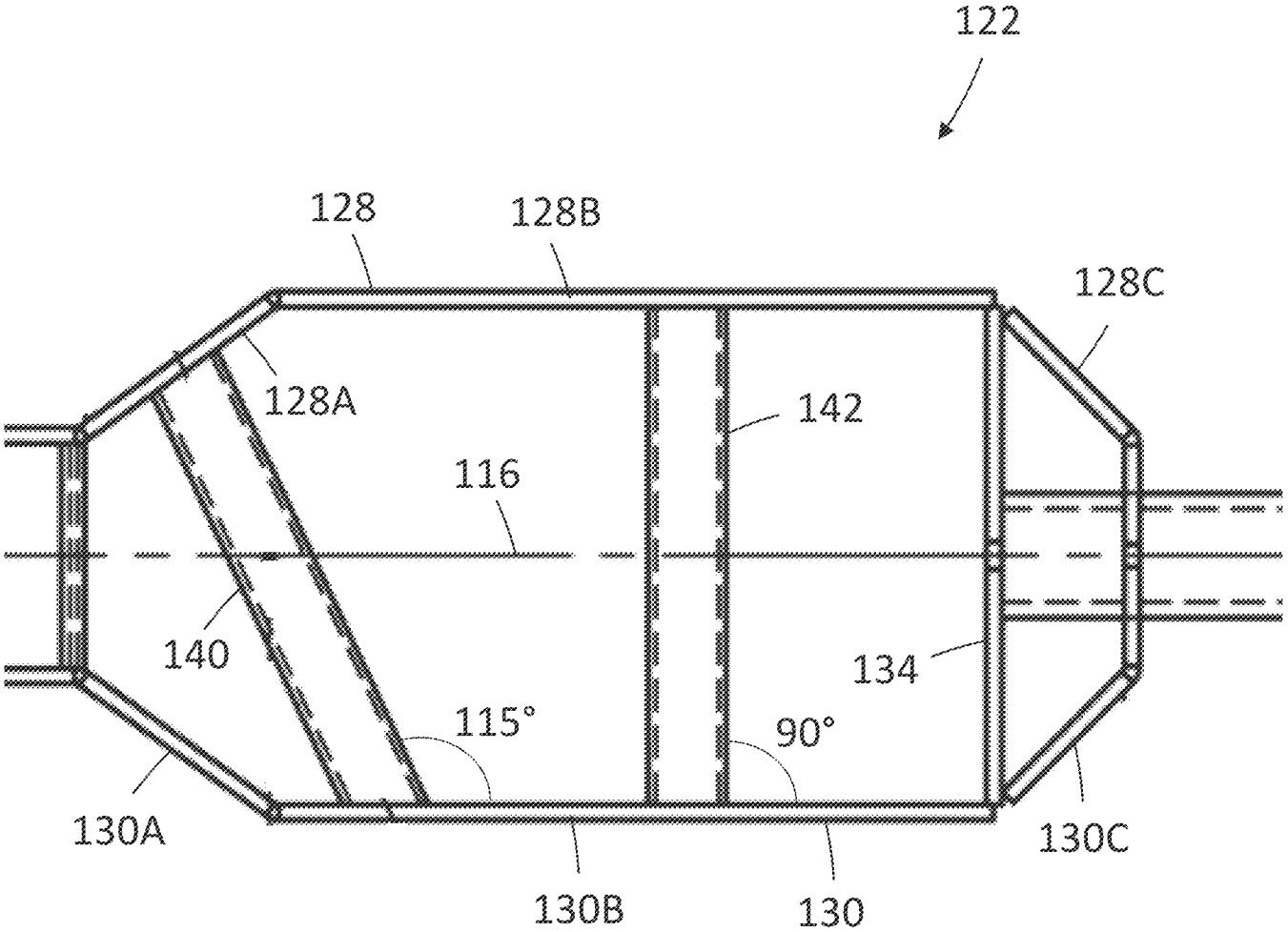

| | | | | |
|---|---|---|---|---|
| 2021/0154523 | A1* | 5/2021 | Hitman | A63B 23/1236 |
| 2023/0173332 | A1* | 6/2023 | Bauerle | A63B 21/0724 482/115 |
| 2023/0241445 | A1* | 8/2023 | Garcia | A63B 21/4035 482/106 |

OTHER PUBLICATIONS

Kabuki Kadillac Bar Rogue Fitness; https://www.roguefitness.com/kabuki-kadillac-bars; web accessed Mar. 4, 2024; 9 pgs.
Rogue MG 2 Multi Grip Bars Rogue Fitness; https://www.roguefitness.com/rogue-rng-2-multi-grip-bars; web accessed Mar. 4, 2024; 6 pgs.
Rogue MG 1 Multi Grip Bar 2.0; https://www.roguefitness.com/rogue-rng-1-multi-grip-bar-2-0; web accessed Mar. 4, 2024; 6 pgs.
American Press Bar EliteFTS; https://www.elitefts.com/american-press-bar.html; web accessed Mar. 4, 2024; 2 pgs.
American Cambered Grip Bar EliteFTS; https://www.elitefts.com/american-cambered-grip-bar.html; web accessed Mar. 4, 2024; 2 pgs.
Xtreme Monkey Black Steel Swiss Bar; https://www.amazon.com/Xtreme-Monkey-Black-Steel-Swiss/dp/B00N534POQ; web accessed Mar. 4, 2024; 7 pgs.
Gronk Fitness Swiss Bar; https://www.gronkfitnessproducts.com/products/gf-commercial-swis-bar; web accessed Mar. 4, 2024; 5 pgs.
Grey Man Gear Simmons Swiss Bar Review; https://www.garagegymreviews.com/grey-man-gear-simmons-swiss-bar-review; web accessed Mar. 4, 2024; 14 pgs.
Swiss Multi Grip Bar American Barbell; https://americanbarbell.com/products/football-swiss-bar; web accessed Mar. 4, 2024; 5 pgs.
Cambered Swiss Multi Grip Barbell REP Fitness; https://repfitness.com/collections/specialty-barbells/products/cambered-swiss-multi-grip-barbell; web accessed Mar. 4, 2024; 14 pgs.
Simmons Swiss Bar Grey Man Gear; https://greymangear.com/products/simmons-swiss-bar; web accessed Mar. 4, 2024; 8 pgs.
Multi Grip Swiss Barbell; https://www.samsonequipment.com/product/multi-grip-swiss-bar/; web accessed Mar. 4, 2024; 3 pgs.
Log Bar Strongman Training Sorinex Exercise Equipment; https://www.sorinex.com/collections/barbells/products/7-log-training-bar; web accessed Mar. 4, 2024; 4 pgs.
Multi Grip Bar Specialty Barbells Sorinex Exercise Equipment; https://www.sorinex.com/collections/barbells/products/multi-grip-bar; web accessed Mar. 4, 2024; 4 pgs.
Swiss Bar Straight; https://www.mydynamicfitness.com/barbells/swiss-bar---straight; web accessed Mar. 4, 2024; 2pgs.
T-Grip Barbell Equipment at Iron Company; http://www.ironcompany.com/shop-by-brand/t-grip-barbell; web accessed Mar. 4, 2024; 3 pgs.

* cited by examiner

EXERCISE APPARATUSES

CROSS-REFERENCE TO RELATED APPLICATION

This application claims the benefit of, and priority to, U.S. Provisional Application No. 63/420,238 filed on Oct. 28, 2022. The entire disclosure of the above-referenced application is incorporated herein by reference.

FIELD

The present disclosure generally relates to exercise apparatuses, for example, for use in performing exercise and/or weightlifting movements, etc.

BACKGROUND

This section provides background information related to the present disclosure which is not necessarily prior art.

Weight bars are known to be used in connection with various exercises, in which weight plates are positioned on the bars and users then lift the bars and weights for reasons related to fitness. One example weight bar is an Olympic bar, which includes a straight, single shaft extending between two sleeves. The shaft of the Olympic bar includes knurls to provide grip for the user, and the sleeves are configured to receive the weight plates.

DRAWINGS

The drawings described herein are for illustrative purposes only of selected embodiments and not all possible implementations, and are not intended to limit the scope of the present disclosure.

Figure 1C:
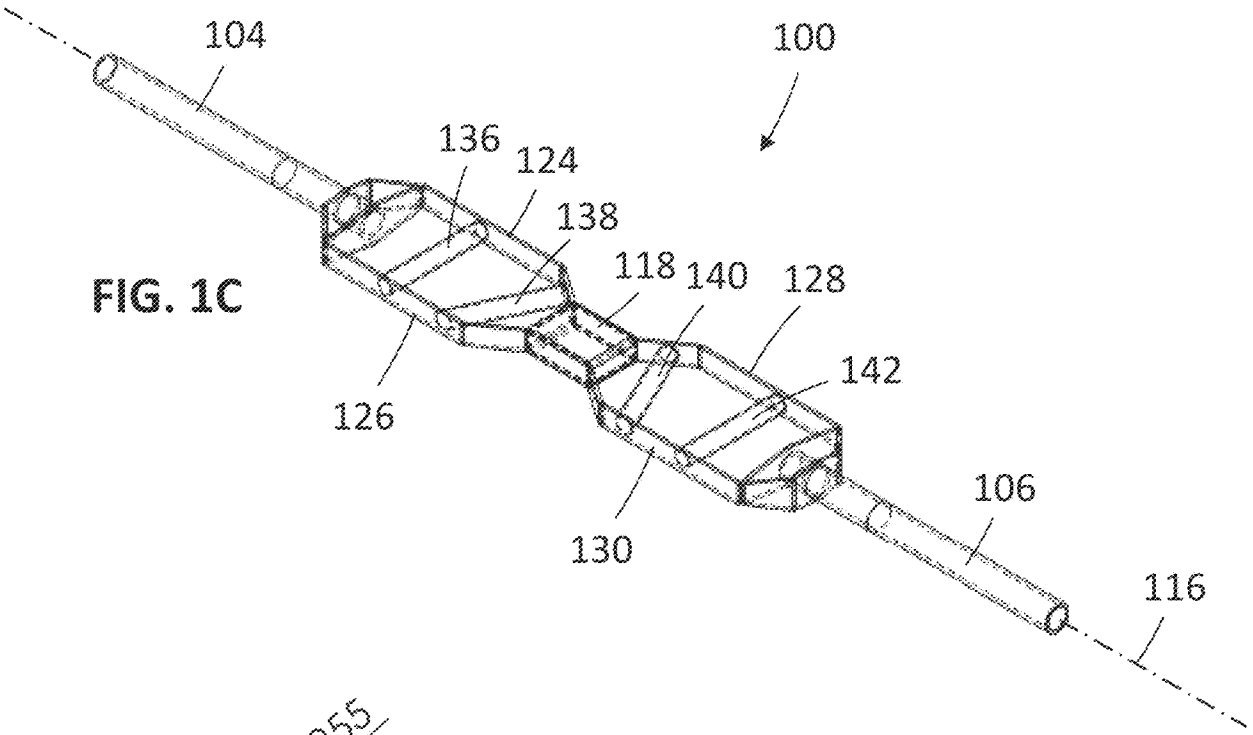
Figure 1D:
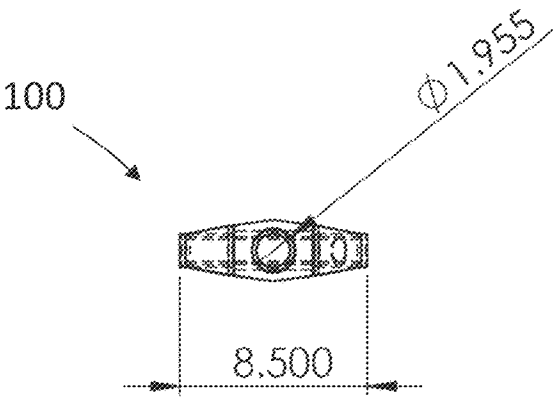
Figure 1E:
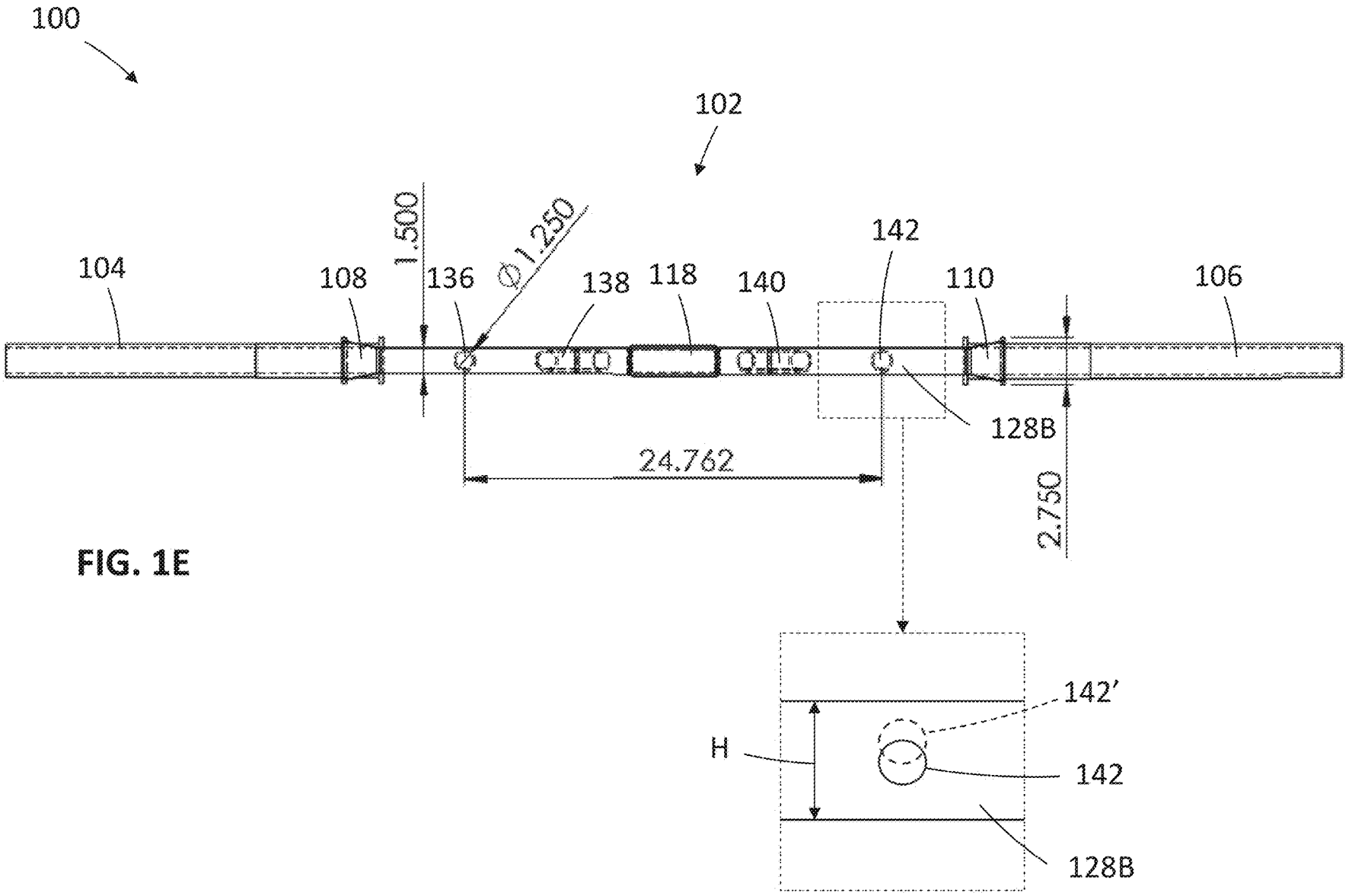
Figure 1F:
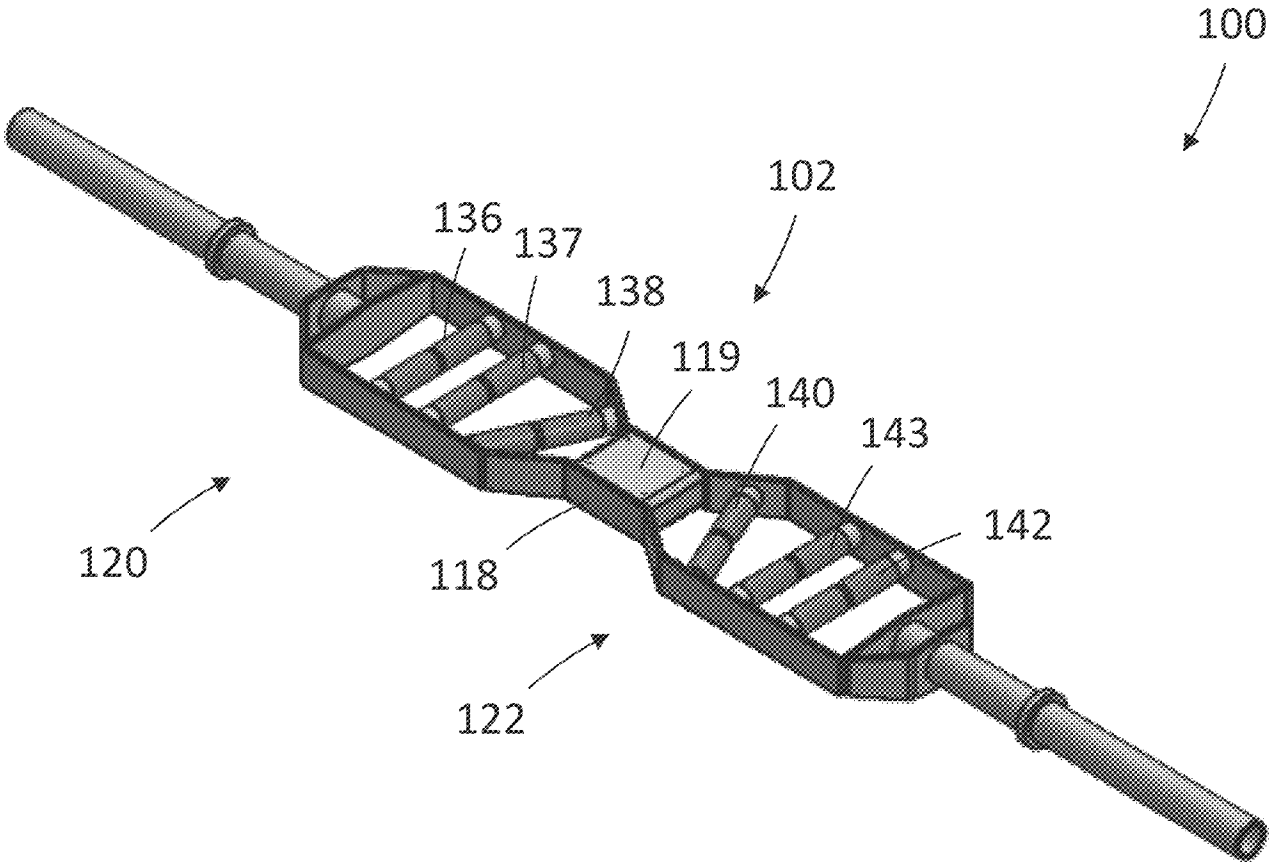
Figure 1G:
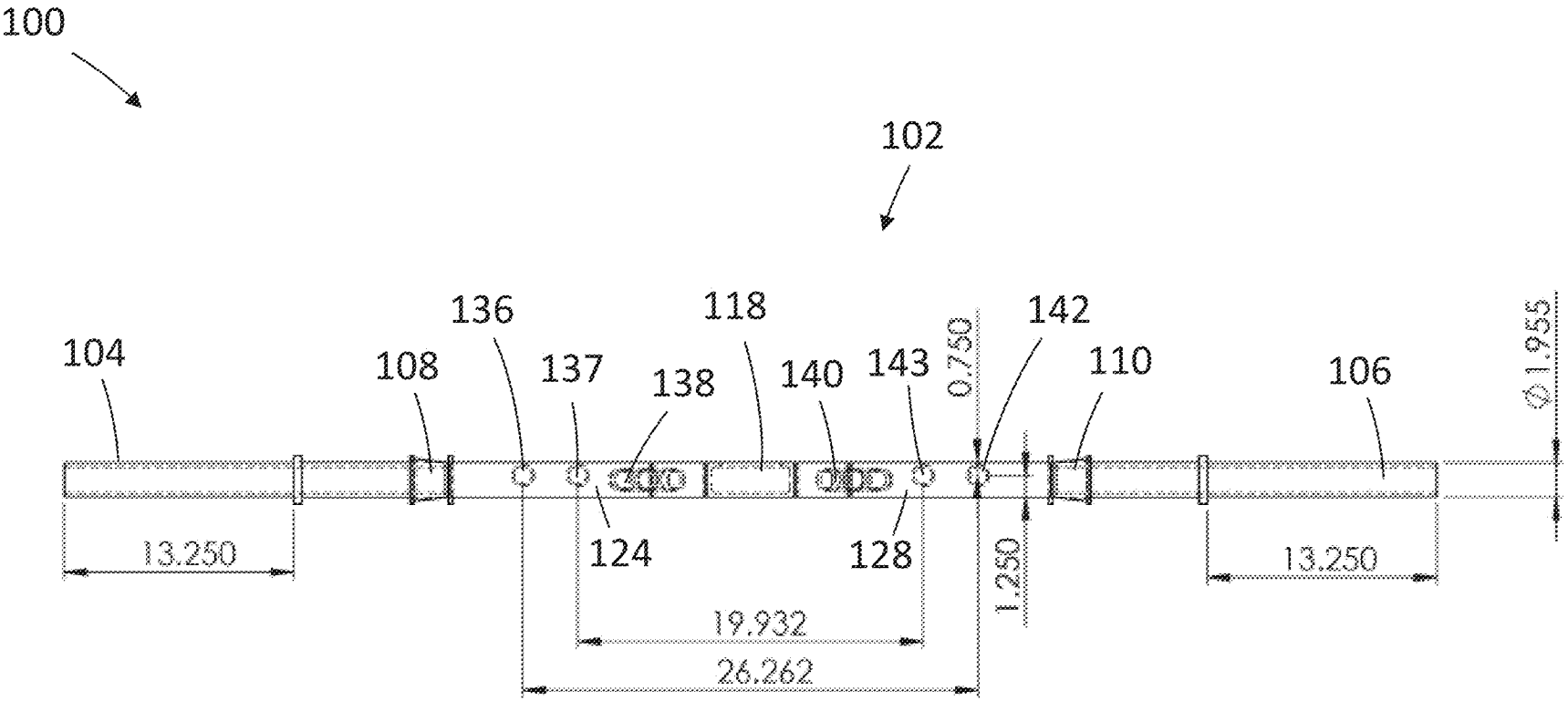
Figure 2A:
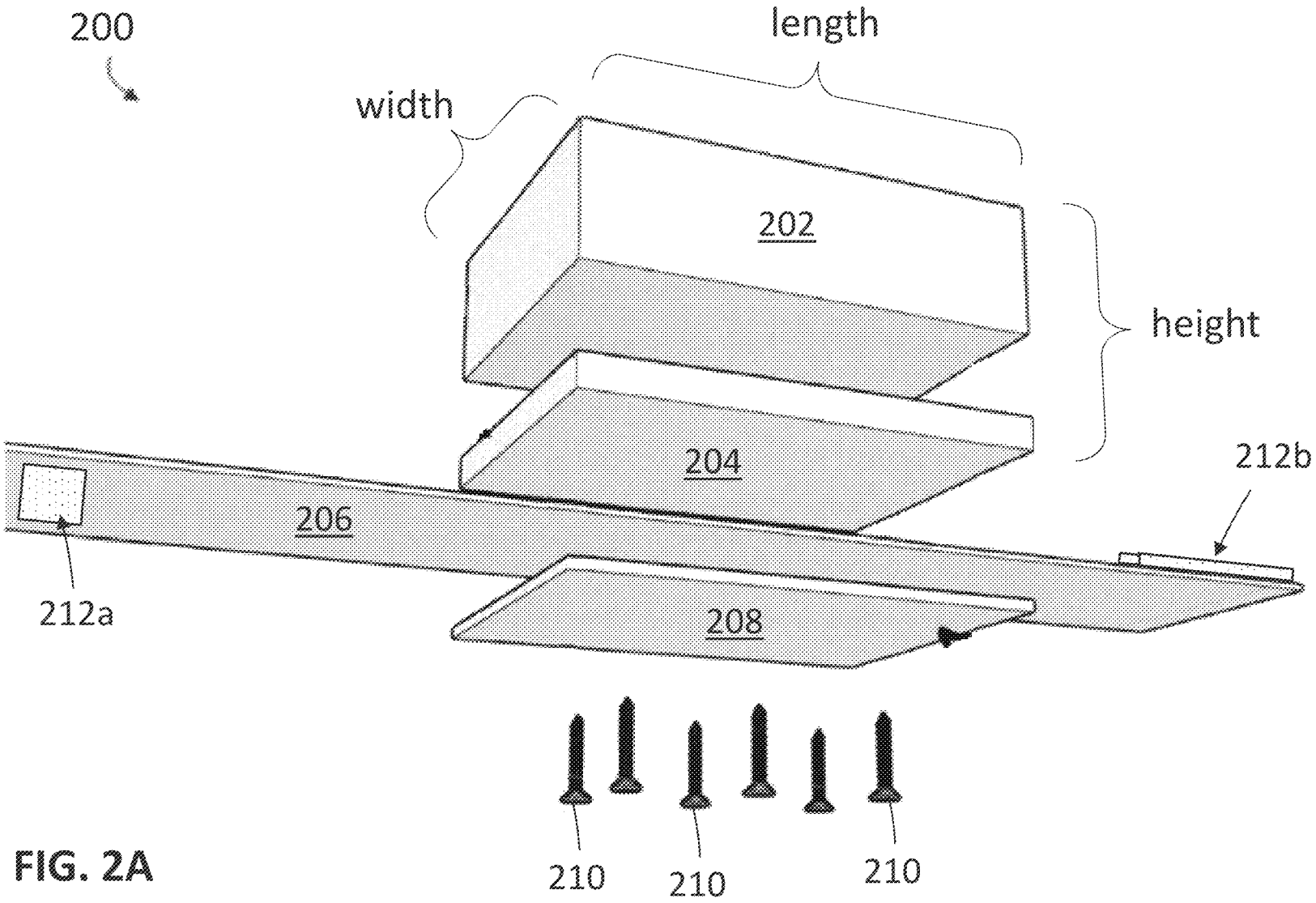
Figure 2C:
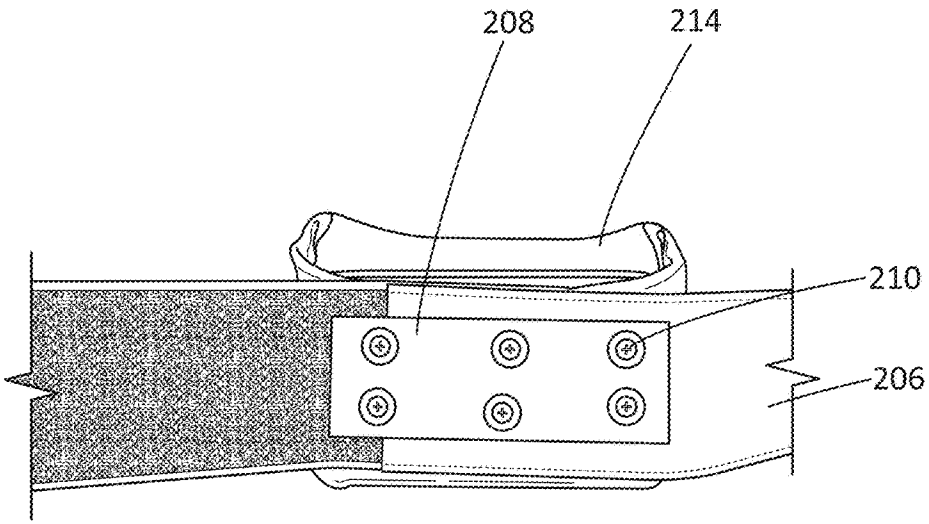
Figure 2B:
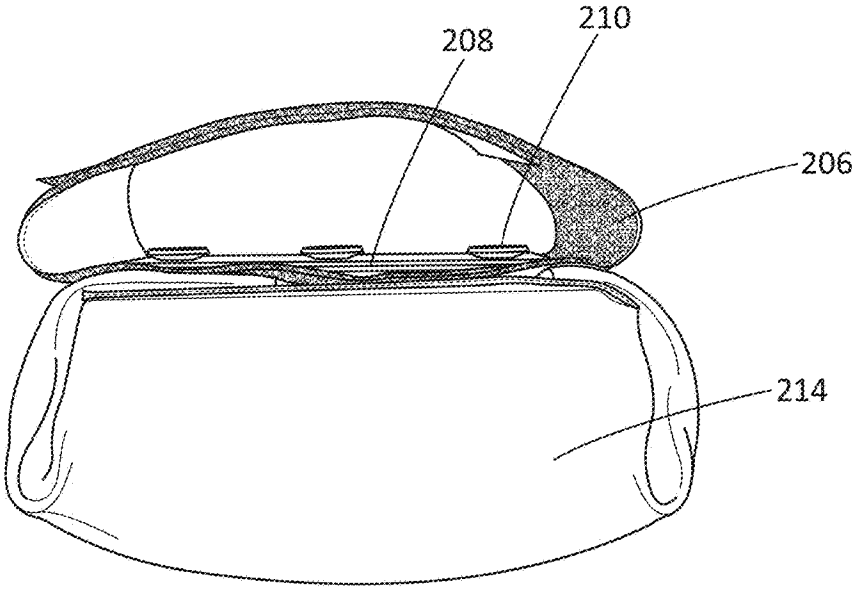
Figure 3:
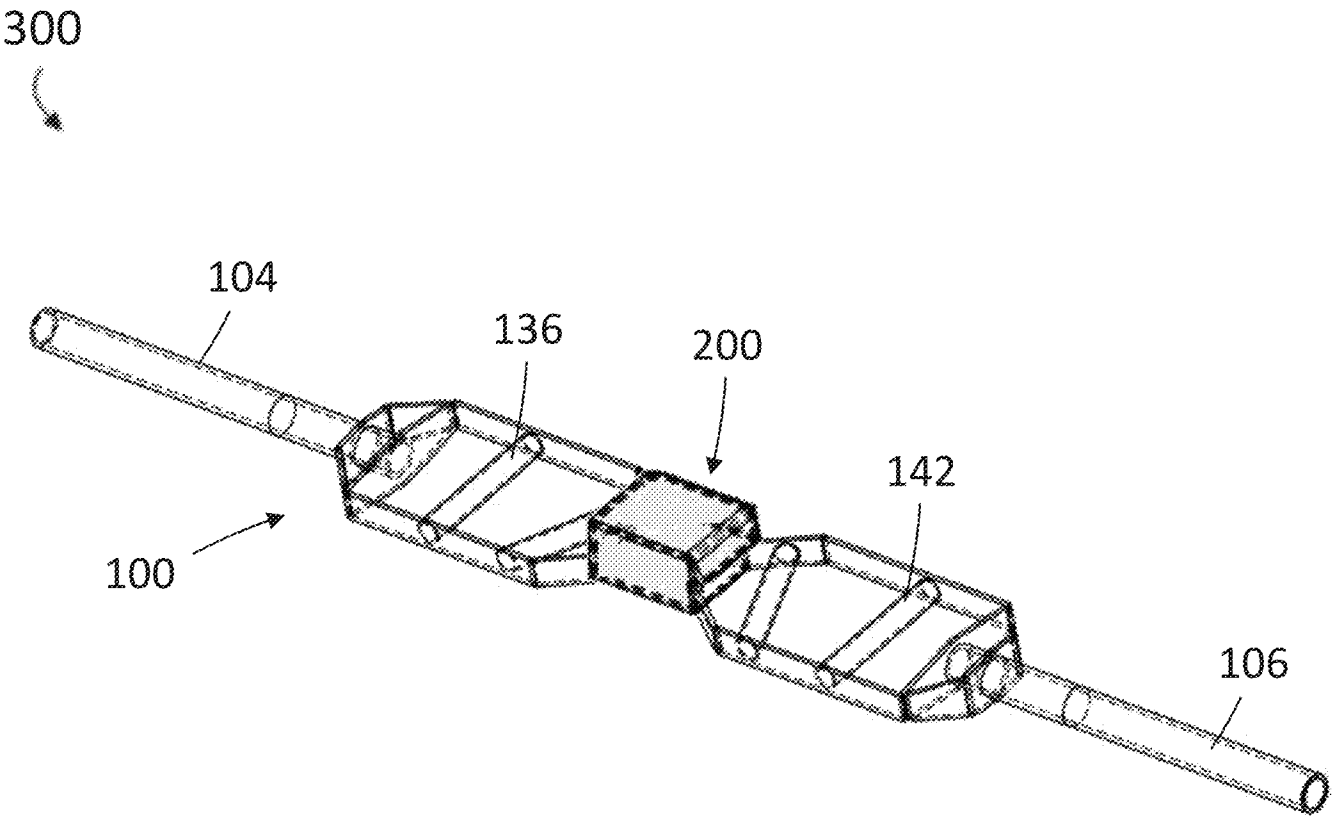

FIGS. 1A-1G include multiple views of an exercise apparatus according to one example embodiment of the present disclosure;

FIGS. 2A-2C illustrate an exercises apparatus according to another example embodiment of the present disclosure; and FIG. 3 illustrates an assembly according to yet another example embodiment of the present disclosure, where the assembly includes the apparatus of FIGS. 1A-1G coupled with the apparatus of FIGS. 2A-2C.

Corresponding reference numerals indicate corresponding parts throughout the several views of the drawings.

DETAILED DESCRIPTION

Example embodiments will now be described more fully with reference to the accompanying drawings. The description and specific examples included herein are intended for purposes of illustration only and are not intended to limit the scope of the present disclosure.

Weight bars generally include grip segments, at which a user is permitted to grip the bars and move the bars. Movement of such a weight bar, though, during one or more exercises, may be impeded from time to time, depending on a shape and/or structure of the weight bar. For example, a neutral grip weight bar may include a substantial grip segment, in which parallel grip supports are spaced apart (e.g., about ten inches, etc.) along a length of the grip segment. The parallel grip supports, however, may limit use of the bar to pressing exercises from a seated position or lying position (e.g., moving the weight bar over the user's face, chin, neck, etc.).

In addition, separately, to limit range of motion for certain pressing exercises (e.g., bench press or board press, etc.) using weight bars, spacers are used/positioned between the bars and the users. In one example, in using a weight bar to perform a bench press exercise, wooden spacers are piled together to define a desired thickness and then held over the user's chest, by another user, to limit the range of motion of the user performing the bench press exercise. In another example, a pad spacer is attached to a standard Olympic bar shaft and rotated/oriented between the shaft and the user. The wooden spacers are inconvenient in that they require additional users to hold the spacers, while the pad spacers may rotate out of position on the round shaft of the Olympic bar, whereby neither solution is convenient, safe or complete.

Uniquely, exercise apparatuses are described herein, which may provide greater versatility in performing exercises (e.g., using weight plates, etc.) (e.g., desired ranges of movement, additional gripping options, etc.) and/or platforms structured for securely mounting pads thereto to set particular/desired ranges of movements when using the exercise apparatuses (e.g., in performing certain pressing exercises, etc.). Additionally, the exercise apparatuses described herein may include unique pads, which are structured as spacers to be mounted or held in place to limit certain exercise movements.

FIGS. 1A-1G illustrate an example apparatus 100, according to one example embodiment of the present disclosure. As will be described, the apparatus 100 may be used to perform various exercises movements (e.g., pressing exercises, pulling exercises, curls, extensions, etc.). In some examples, the apparatus 100 may be used alone to perform the exercises. In other examples, one or more weights may be coupled to the apparatus 100 in connection with performing the exercises and/or one or more pad spacers (e.g., apparatus 200, other pads, or pad spacers, etc.) may be coupled to the apparatus 100 in connection with performing the exercises. In addition, example dimensions and angles are provided for the apparatus 100 in FIGS. 1A-1G. The dimensions and angles provide an accurate technical representation/disclosure of the relative sizes, spacings, positions, orientations, ratios, etc., of the various parts of the apparatus 100 relative to each other in the illustrated embodiment. It should be appreciated, though, that the dimensions are example only, and are provided for purposes of illustration in the given illustrated embodiment (without limitation). It should therefore also be appreciated, then, that the dimensions included in FIGS. 1A-1G are not however required in all embodiments of the apparatus 100, or other apparatus embodiments consistent with the present disclosure. As such, it should be appreciated that one or more parts, sections, features, etc., of the apparatus 100 may have other dimensions and/or relative angular orientations, positions, etc. in other embodiments (e.g., one or more of the other dimensions and/or angles described below, etc.).

As shown in FIG. 1A, in this example embodiment, the apparatus 100 is a weight bar, which includes a grip section 102, a first sleeve 104 disposed toward one end portion of the apparatus 100 and a second sleeve 106 disposed toward an opposite end portion of the apparatus 100. The grip section 102 is disposed (e.g., centrally, etc.) between the sleeves 104, 106, with the sleeve 104 coupled to a first end of the grip section 102 and the sleeve 106 coupled to an opposite, second end of the grip section 102. In some example embodiments, the sleeves 104, 106 may be rotatable relative to the grip section 102 (e.g., via bearings, etc.).

In other example embodiments, the sleeves 104, 106 may instead be fixed in position relative to the grip section 102.

The sleeves 104, 106 are separated from and/or distinguished from the grip section 102 by shoulders 108, 110, respectively. The sleeves 104, 106 are structured to support weights, and in particular, weight plates of various different weights (not shown) (e.g., five lbs., ten lbs., twenty-five lbs., forty-five lbs., etc.) and/or weight plates of various different configurations (e.g., circular weight plates, hex weight plates, bumper weight plates, etc.). The weights are aligned with ends 112, 114 of the corresponding sleeves 104, 106 (e.g., at the end portions of the apparatus 100, etc.) and slid on to the sleeves 104, 106, and pushed against the respective shoulders 108, 110, as a stop for the weights (and to help retain, hold, secure, etc. the weights in a desired position on the sleeves 104, 106 and apparatus 100). In particular, each of the weights has an opening defined therein (e.g., a central opening, etc.) configured to align with either the sleeve 104 or the sleeve 106, and the sleeve is received in (and through) the opening as the weight is slid on the sleeve 104, 106. The weights may then be secured on (or to) the sleeves 104, 106 (e.g., in the desired position against the shoulders 108, 110, etc.), by one or more collars, clamps, etc. (not shown) which similarly slide onto the sleeves 104, 106 from the ends 112, 114 and lock in place. Additionally, the sleeves 104, 106 are structured to support one or more bands and/or straps and/or chains (e.g., rubber resistance bands/straps, etc.), whereby the bands and/or straps and/or chains may be positioned over (or around) and/or coupled to one or both of the sleeves 104, 106. In general, therefore, the sleeves 104, 106 of the apparatus 100 are structured to receive and support the weight (which, again, may include weight plates, etc.), the bands, the straps, the chains, etc.

In the illustrated embodiment, and by way of example only, the sleeves 104, 106 each include a length of more than about ten inches (e.g., about 12 inches, about 13 inches, about 14 inches, about 15 inches, about 16 inches, etc.), and a diameter of between about one inch and about three inches (e.g., about 1.5 inches, about 1.7 inches, about 1.96 inches, about 2.1 inches, about 2.3 inches, etc.). That said, the particular dimensions of the sleeves may be different in other embodiments. In various embodiments, the grip section 102 includes dimensions whereby the apparatus 100 may be received (e.g., racked, supported, etc.) in a conventional weight lifting rack (e.g., a squat rack, a bench, a power rack, etc.) at members 148, 150 (e.g., via pins, hooks, etc. of the weight lifting rack, etc.).

With continued reference to FIG. 1A, the apparatus 100 defines a long axis (or longitudinal axis) referenced 116, which extends through the grip section 102 and the sleeves 104, 106, generally from the end 112 to the end 114. In this embodiment, the sleeves 104, 106 are generally aligned on (e.g., are generally coaxial with, etc.) the axis 116. In other embodiments, the axis 116 may extend through the sleeves 104, 106, such that the sleeves are again generally aligned on (e.g., are generally coaxial with, etc.) the axis 116, while the grip section 102 is disposed generally below or generally above the axis 116 (e.g., with one or more components of the grp section 102 spaced generally above or generally below the axis 116 and generally out of axial alignment with the sleeves 104, 106, etc.).

In this example embodiment, the apparatus 100, and specifically, the grip section 102, includes a support platform 118 (or support portion, etc.), which is disposed generally centrally (e.g., in the middle, etc.) of the apparatus 100 (along the axis 116). The platform 118 is structured to support a pad spacer, for example, and to cooperate with the pad spacer to secure the pad spacer in place (e.g., on the apparatus 100 and/or relative to a user, etc.) during one or more different exercises (as the exercises are being performed by the user). Here, the platform 118 is formed as a box (e.g., defines a generally box shape, etc.). In one example, the platform 118 is formed with plates (e.g., formed from steel having a thickness of about 0.25 inches, etc.) located on (or covering) an upper and lower side portions of the platform 118 (e.g., a top and bottom of the platform 118 in FIG. 1E, for example). In another example, the platform 118 is formed as one piece of steel, cut and welded to form the box-shape of the platform 118. In the illustrated embodiment, the platform 118 is generally rectangular in shape, measuring approximately five inches by approximately four inches, as indicated. In various embodiments, the platform 118 defines a mounting surface, which may be generally or relatively planar with the overall grip section 102, or parts thereof. The platform 118 is configured to reduce, accommodate, and/or withstand torque in the grip section 102, while acting as (or providing or defining) a mounting surface for the pad spacer or other accessories (e.g., a logo, etc.), etc. In one example, the platform 118 (e.g., one or both of the plates located (or covering) the upper and lower side portions of the platform 118 (see plate 119 in FIG. 1F), etc.) includes multiple threaded holes, with which a logo plate may be mounted to the platform 118 (on one or both sides).

It should be appreciated that the platform 118 may include a different size and/or configuration in other embodiments. For example, in some embodiments, the platform 118 may define a generally square shape. In connection therewith, it should also be appreciated again that the dimensions provided for the platform 118 in the drawings (and described herein) are example only, and that the platform 118 may include other dimensions in other example embodiments. In addition, in some embodiments the platform 118 may include non-solid plates located on (or covering) one or both of the upper and lower side portions (e.g., perforated plates, mesh, etc.), which is sufficient to support a pad spacer secured thereto, etc. In one embodiment, the upper and/or lower plate of the platform 118, for example, may include or define a male or female part of a fastener that can then be used to secure the pad spacer to the platform 118. Additionally, in some embodiments, the platform 118 may include only one plate located on (or covering) an upper or lower side portion of the platform 118 (with the other side portion then open), or the platform may not include any plate at all (whereby the upper and lower side portions of the platform 118 or open/uncovered, etc.).

As further shown in FIG. 1A, the grip section 102 includes a first grip segment 120 and a second grip segment 122. The grip segments 120, 122 include supports 124, 126, 128, 130, 132, 134 generally defining an outer portion or outer perimeter of the grip segments 120, 122. In the illustrated embodiment, each of the supports 124-134 defines a generally rectangular cross-section and each have a thickness dimension of less than about one inch (e.g., about 0.25, etc.) (or more than one inch, e.g., about two inches, etc.) and a width dimension (e.g., a height H as viewed in FIG. 1E, etc.) of between about one inch and about four inches (e.g., about 1.5 inches in the illustrated embodiment, or about two inches or about two and a half inches in other embodiments, etc.). It should be appreciated that other dimensions and/or cross sections of supports (for grip segments 120, 122) may be employed in other apparatus embodiments.

The grip segments 120, 122, also include handles 136, 138, 140, 142. Each of the handles 136, 138, 140, 142 is structured to be gripped by a user during one or more exercises. For instance, the user may grip corresponding handles 136 and 142 (as a handle pair, etc.), or the user may grip corresponding handles 138, 140 (as a handle pair, etc.), etc., during the exercises, etc. In the illustrated embodiment, the handles 136, 138, 140, 142 each define a generally circular cross-section and each have a diameter of between less than about one inch, or about one inch to about three inches, or more or less, etc. The handles 136, 138, 140, 142 may further include knurls to promote gripping of the handles 136-142 by a user. That said, it should be appreciated that other configurations of handles (e.g., handles having other than circular cross-sections, handles having sizes other than described and/or illustrated herein, etc.), or a different number of handles, may be included in other apparatus embodiments. For example, as shown in FIG. 1F, in some examples, the grip segments 120, 122 of the grip section 102 (of the apparatus 100) each additionally include corresponding handles 137, 143. In connection therewith, handles 137, 143 are positioned generally adjacent (or next to) the handles 136, 142 and are generally parallel to or with the handles 136, 142. That said, in general herein, it should be appreciated that the handles 136-143 may be coupled to the respective supports 124-130 in a suitable manner (e.g., fixedly/permanently, releasably, etc.), for example, via welding, via one or more fasteners (e.g., a bolt(s), etc.), etc.

It should be appreciated that in the illustrated embodiment the grip segments 120, 122 are mirror images of each other (such that the handles 136-143 may be viewed as defining handle pairs across the grip segments 120, 122), and therefore the following description of the grip segment 122 is applicable to the grip segment 120. As such, as shown in more detail in FIG. 1B, the supports 128, 130 include segments A, B, and C, respectively. The segment 128A defines an angle with segment 128B, for example, of between about 120 degrees and about 160 degrees. The segment 128B defines an angle with segment 134, for example, of about 90 degrees, and an angle with the segment 128C, for example, of between about 120 degrees and about 160 degrees. The segments 130A, 130B, and 130C define similar relative angles (whereby, in the illustrated embodiment, the segments 130A-C generally mirror the segments 128A-C). It should be appreciated that the relative angles between the various segments of the supports 128, 130 may be otherwise in other apparatus embodiments.

As shown, the handle 142 extends between the segment 128B and the segment 130B (broadly, between the supports 128, 130), and defines an angle of about 90 degrees with each of the supports 128 and 130 (and with the axis 116). The handle 140 extends between the segment 128A and the segment 130B (broadly, between the supports 128, 130) and defines an angle of about 115 degrees with the segment 130B (and with the axis 116), as shown. That said, again, it should be appreciated that the angles formed between the supports 128, 130 and the handles 140, 142 (and a different number and/or shape of supports/handles) may be different in other embodiments, depending on, for example, the specific grip angle desired for the apparatus 100, etc. Further, it should be appreciated that the supports 128, 130 may include a continuous piece of steel or other suitable material, for example, extending from the sleeve 104 to the platform 118, with the appropriate bends therein. In another example, the segments of the supports 128, 130 may be welded together at the appropriate angles. In still other example embodiments, the continuous piece of steel may extend from the sleeve 104 to the sleeve 106, thereby forming part of the platform 118. Moreover, as indicated above, in some examples the grip segments 120, 122 may include one or more additional handles. For example, as shown in FIG. 1F, in some examples, the grip segments 120, 122 of the grip section 102 (of the apparatus 100) each additionally include corresponding handles 137, 143. In connection therewith, the handles 137, 143 each define an angle of about 90 degrees with each of the supports 128 and 130 (and with the axis 116) of the apparatus 100 (e.g., thereby providing pairs of handles defining a neutral grip arrangement, etc.).

In addition, with additional reference to FIG. 1E, in the illustrated embodiment, the handles 140 and 142 (and the handles 136 and 138) are located in the center of the apparatus 100, height wise relative to the supports 128, 130 (e.g., from top to bottom as viewed in FIG. 1E, etc.), whereby the apparatus 100 is generally symmetric. That said, it should be appreciated that the handle 142 (and/or one or more of handles 136-140, 143) may instead be offset (as indicated by the dotted lines in FIG. 1E illustrating offset of handle 142') in the height-wise direction of the support 128 (e.g., along height H of segment 128B thereof, etc.). The offset may be by a fraction of an inch, or more (e.g., about 0.25 inches, about 0.5 inches, about 0.75 inches, about one inch, or more or less, etc.) and may be included to improve the performance, stability, etc., of the apparatus 100 in one or more different exercises, including, for example, to avoid instances of instability, wobble, and/or tipping, etc. With reference to FIGS. 1F and 1G, in one particular example in which the assembly includes handles 136-143, the handles 136, 137, 142, 143 oriented at an angle of about 90 degrees relative to the axis 116 and are offset in the height-wise direction 145 of the supports 124-130 while the handles 138, 140 are not offset (e.g., are located generally in the center of the apparatus 100 height wise relative to the supports 124-130; etc.).

With reference again to FIG. 1A, the supports 124 and 128 define an outer plane of the apparatus 100, as indicated by the dotted line therebetween. The outer plane defines an indent 144 (or void, or opening, or recess, etc.) with the platform 118 (e.g., with an upper sidewall of the platform 118 as viewed in FIG. 1A, etc.). The indent 144 includes a depth dimension of between about 2 inches and about 2.5 inches (e.g., about 2.2 inches in the illustrated embodiment, etc.) in some example embodiments, or between about one inch to about four inches, or between about two inches and about five inches, or more or less, in other embodiments. In this manner, the apparatus 100 defines a generally hour-glass shape and/or is configured to perform certain exercises, during which the apparatus 100 is passed in front of the user's face (whereby facial clearance is provided and/or the face passes through the indent 144). The apparatus 100 includes a similar indent 146 defined between the support 126, the platform 118 (e.g., an lower sidewall of the platform 118 as viewed in FIG. 1A, etc.) and the support 130.

With additional reference to FIG. 1C, in connection with the indents 144, 146, the platform 118 is accessible on all sides, for example, to permit mounting one or more accessories thereto (e.g., a pad spacer, etc.).

The apparatus 100 may be finished (e.g., a surface of the apparatus 100, etc.) consistent with the use thereof, for example, whereby the apparatus 100 may be powder coated, or Cerakoted, etc. In addition, the apparatus 100 in this embodiment is configured with a secure construction, whereby none of the handles 136-143, for example, or other parts of the apparatus 100, are removeable by the user (e.g., without destroying the apparatus 100, etc.) (e.g., the handles may be secured in place and not movable by the user to different locations, etc.). The construction may be otherwise in other embodiments. For example, in some embodiments, one or more of the handles 136-143 may be removably coupled to the apparatus such that the handles may be removed and/or replaced as desired.

The apparatus 100, in view of the above, may be employed for use with a number of exercises, including certain weight lifting movements such as, but not limited to, a flat chest press, an incline chest press, a board chest press, a standing or seated overhead shoulder press, a bicep curl, an overhead triceps press, a bent over row, a single leg RDL, a reverse pull up (when the apparatus 100 is racked in a weight lifting rack), other pressing motions (e.g., when coupled or connected to one or more swinging arms, etc.), or other suitable exercises, etc.

FIGS. 2A-C illustrate an example apparatus 200, according to another example embodiment of the present disclosure. As will be described, the apparatus 200 may be used with the apparatus 100 described above, for example, as a spacer for use when performing various exercises with the apparatus 100. Or, the apparatus 100 may be used with other weight bars (e.g., Olympic weight bars, etc.) again, for example, as a spacer or use when performing various exercises with the weight bars.

In this example embodiment, the apparatus 200 is generally a pad assembly configured to provide a spacing, for example, between a weight bar (e.g., the apparatus 100, another weight bar, etc.) and a use during certain pressing exercise movements. As shown, the apparatus 200 is constructed, in this example embodiment, of a pad 202, a support member 204, a strap 206, and a plate 208. The strap 206, then, is configured to couple the apparatus 200 to a desired weight bar. The pad 202 may be constructed from desired material such as, without limitation, foam (e.g., opened cell foam, closed cell foam, memory foam, rebound foam, latex foam, resilience foam, etc.) (e.g., made from polyurethane, etc.), rubber (e.g., solid, filled with air, etc.), wood, one or more different plastics, metals, or other suitable materials, etc.

In addition in this example embodiment, the pad 202 may include a length and width consistent with the platform 118 of the apparatus 100 (e.g., about four inches wide by about five inches long, etc.), for example, or may include any other suitable dimensions within the scope of the present disclosure. Specifically, it should be appreciated that while the apparatus 200 may be used with the apparatus 100, it is not limited for use only with the apparatus 100 (and instead may be used with other weight bars, etc.). The height of the pad 202 may vary depending on the particular use of the apparatus 200. Specifically, the height of the pad 202 generally indicates the overall height of the apparatus 200, which may be employed to restrict (or limit, or define) a certain range of movement in an exercise. For example, in a bench press, the apparatus 200 may be used to restrict, or limit, a lower range of motion, as the apparatus 200 comes to rest or contacts a user's chest (such that the weight bar to which the apparatus 200 is coupled does is stopped, or spaced, from contacting the user's chest by the apparatus 200).

In this manner, the height of the pad 202 may be a desired height based on (or corresponding to) the desired restriction of movement for the exercise (e.g., about one inch, about two inches, about three inches, about four inches, about five inches, or more or less or dimensions therebetween, etc.). Moreover, in some examples, a series of apparatuses 200 may be provided, with the pad 202 in each being a different height, to provide a user with different options in selecting an appropriate restriction on movement for a particular exercise and/or particular purpose and/or particular user. For example, an apparatus 200 with a four-inch restriction may be appropriate for one exercise or user, while an apparatus 200 with a two-inch restriction may be appropriate for a different exercise or user. Further, in some example embodiments, a height of the pad 202 (and/or apparatus 200) may be adjustable (e.g., by selectively or releasably coupling multiple pads together, etc.), whereby the apparatus 200 may be used to accommodate different restrictions as desired.

With continued reference to FIG. 2A, the support member 204 is configured to support the pad 202. As such, the support member 204 may include a generally rigid material to thereby inhibit unwanted movement of the pad 202. The support member 204 may be constructed from, for example, wood, metal, plastic, or other suitable materials and may define a generally board shape (e.g., generally flat and planar shape, etc.). The pad 202 may be coupled to the support member 204 via an adhesive or other means (e.g., hook-and-loop fasteners, mechanical fasteners, etc.), to prevent relative movement, or not. As shown, in this example a width and length of the support member 204 are generally consistent with the width and length of the pad 202, but variations in the width and/or length of the support member 204 may be included in other example embodiments. In addition, the support member 204 may include a desired height, for example, less than one inch, about one inch, more than one inch, etc. The height of the support member 204 may be informed by the material used to construct the support member 204, the necessary support performance for the pad 202 and/or the strap 206, the desired overall height of the apparatus 200, etc.

As described, the strap 206 is configured to couple the pad 202 (and, more generally, the apparatus 200) to a desired weight bar. In the illustrated embodiment, the strap 206 includes a fabric strap (e.g., canvass, nylon, Kevlar, rubber, silicone, leather, faux-leather, cotton, polyethylene, etc.) having a width of approximately that of the width of the pad 202 and the support member 204, as shown in FIG. 2A. A length of the strap 206 is sufficient such that end portions of the strap 206 extend generally beyond the length of the pad 202 and the support member 204 (e.g., such that the end portions of the strap 206 extend from the apparatus 200, etc.), provide enough length to the strap 206 to wrap around a desired weight bar (e.g., around the platform 118 of the apparatus 100, around another surface of a weight bar, around platforms and/or frames (of any shape, etc.) of other bars, etc.) and fasten as appropriate. In this example embodiment, the strap includes fasteners 212*a-b* (broadly, fastener or fastening structures) for use in fastening, coupling, etc., the end portions of the strap 206 together (e.g., to secure the strap 206 to the desired weight bar, etc.). The fasteners 212*a-b* may include, for example, hook-and-loop fasteners, which require an overlap of the first end portion of the strap 206 with the second end portion of the strap 206, so that the hooks of the fasteners may interact with and engage the loops of the fasteners (e.g., as shown in FIG. 2B, etc.).

While only one strap 206 is included in the apparatus 200 in the illustrated embodiment, it should be appreciated that another number of straps may be included in other embodiments. For example, the apparatus 200 may include two straps, running along the length of the pad 202 and support member 204, which includes hook-and-loop fasteners to secure the apparatus 202 to the platform 118 of the apparatus 200, for example, or to another weight lifting bar in general. In addition, other types of fasteners (or fastening means or fastening structures) may be used in lieu of (or in addition to) the hook-and-loop fasteners, in other embodiments, including, for example, snaps, magnets, magnetic switches, buckle-style fasteners, thumb-screws, zippers, male/female clips (e.g., plastic, etc.), rachet fasteners, physical connectors, or combinations thereof, etc., which may be used in combination with a strap, or potentially, in place of the strap 206 (i.e., the strap is omitted (along with the plate 208), etc.), etc. In at least one or more embodiments, the apparatus may define a post, or connector, extending from the support member 204, which extends into or through the platform 118 (or vice-versa), to be secured therein, or thereon or thereto, or otherwise, by a mating connector (e.g., a clamp, a collar, etc.).

With continued reference to FIG. 2A, the plate 208 is configured to secure the strap 206 to the support member 204, by fasteners 210. As such, the plate 208 may include a generally rigid material to thereby inhibit unwanted movement of the pad 202 and/or strap 206 (and assembly 200 in general). The plate 208 may be constructed from, for example, wood, metal, plastic, or other suitable materials and may define a generally board shape (e.g., generally flat and planar shape, etc.). As shown, the width and length of the plate 208 are generally consistent with the width and length of the pad 202 and the support member 204, in this example, but variations in the width or length of the plate 208 may be included in other example embodiments. For example, the plate 208 may include multiple plates, each specific to one or more of the fasteners 210, or otherwise. The height or thickness of the plate 208 in generally minimal or limited and/or specific to the type of material used in constructing the plate 208 and/or performance to secure the strap 206 and/or desired height of the apparatus 200, etc. In various embodiments, the plate 208 may define holes to receives the fasteners 210, which in the embodiment are screws, but may be otherwise in other embodiments.

As shown in FIG. 2B-C, the pad 202 and the support member 204 are wrapped in (or are included in) a casing 214 (or housing), which may be made from leather, faux-leather (e.g., NAUGAHYDE, BOLTAFLEX, etc.), plastic, canvas, or other suitable material, etc. The casing 214 is configured, generally, to protect the pad 202 (e.g., from absorbing sweat, etc.), whereby the casing 214 is often moisture resistant. In one or more embodiments, the casing 214 may be omitted.

As described, it should be appreciated, again, that the apparatus 200 may be configured to be secured to a weight bar, which does not include a platform, for example, as shown in the apparatus 100 of FIGS. 1A-1G. In connection therewith, as described, the apparatus 200 may include fasteners 212*a-b* such as, for example, hook-and-loop fasteners disposed on the strap 206 with sufficient length to wrap around a conventional weight bar (e.g., a conventional Olympic bar (e.g., having a round cross-section, etc.) or around a conventional neutral grip bar (e.g., having two or more round or flat supports separated by handles, etc.), etc.). Broadly, the apparatus 200 or variations thereof may be applied or secured to other permanent or non-permanent structures of bars that are flat or to round/flat structures that are linear to one another and form a flat structure (whereby the apparatus 200 may bridge the structures), or variations thereof.

FIG. 3 illustrates an assembly 300 including the apparatus 100 and the apparatus 200. As shown, in this example, the apparatus 200 is coupled to the apparatus 100 generally at the platform 118, and is thereby supported on the platform 118. In doing so, the pad 202 of the apparatus 200 is positioned generally over the platform 118 (e.g., on a plate covering the platform 118, etc.), whereby the apparatus 200 (and the pad 202 thereof) is generally aligned with the platform 118. The end portions of the strap 206 are then positioned generally through the respective indents 144, 146 (or through openings of the grip segments 120, 122) and the platform 118 (e.g., generally around the side walls of the platform 118 and under the platform 118 as viewed in FIG. 3, etc.). The fasteners 212*a-b* of the end portions of the strap 206 may then be aligned and engaged to secure the end portions of the strap together (and to secure the strap 206 on the apparatus 100). In this position, the plate 208 is positioned relatively flat against the platform 118 (e.g., against a plate covering the platform 118, against upper portions of sidewalls defining the platform 118, etc.) and the end portions of the strap 206 are secured, thereby inhibiting rotational movement (or other unwanted movement) of the apparatus 200 relative to the platform 118 and apparatus 100 (e.g., during use of the apparatus 100 to perform an exercise movement, etc.).

In addition, the pad 202 of the apparatus 200 extends (or protrudes) generally away from the platform 118 (and apparatus 100) to provide a desired spacing between the apparatus 100 and a user, for example, when performing the exercise movement (as generally described herein).

When desired, the apparatus 200 may be removed from the apparatus 100 by releasing (e.g., un-coupling, etc.) the fasteners 212*a-b* and removing the apparatus 200 from the apparatus 100. The apparatus 200 may then be re-coupled to the apparatus 100 or to another weight bar as desired.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When a feature is referred to as being "on," "engaged to," "connected to," "coupled to," "associated with," "included with," or "in communication with" another feature, it may be directly on, engaged, connected, coupled, associated, included, or in communication to or with the other feature, or intervening features may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" and the phrase "at least one of" includes any and all combinations of one or more of the associated listed items.

Although the terms first, second, third, etc. may be used herein to describe various features, these features should not be limited by these terms. These terms may be only used to distinguish one feature from another. Terms such as "first," "second," and other numerical terms when used herein do not imply a sequence or order unless clearly indicated by the context. Thus, a first feature discussed herein could be termed a second feature without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of example embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus for use in performing an exercise movement, the apparatus comprising:

a grip section including at least one pair of handles;

a first sleeve coupled to a first end of the grip section; and a second sleeve coupled to a second end of the grip section, which is opposite the first end, each of the first and second sleeves structured to receive one or more weight plates;

wherein the grip section includes a first grip segment, a second grip segment, and a platform positioned between the first grip segment and the second grip segment;

wherein the platform is positioned centrally along a longitudinal axis of the apparatus, between the first grip segment and the second grip segment, and wherein the platform defines a box-shape having a top surface, a bottom surface, and side surfaces; and wherein the top surface and the bottom surface of the platform each defines a rectangular shape, and wherein a first one of said side surfaces of the platform forms an inner wall of the first grip segment and a second one of said side surfaces of the platform forms an inner wall of the second grip segment.

2. The apparatus of claim 1, wherein the grip section includes a first pair of handles and a second pair of handles.

3. The apparatus of claim 2, wherein the first pair of handles includes a first handle positioned in the first grip segment and a second handle positioned in the second grip segment and spaced apart from the first handle along a longitudinal axis of the apparatus, the first handle and the second handle oriented at an angle of about ninety degrees relative to the longitudinal axis of the assembly.

4. The apparatus of claim 3, wherein the second pair of handles includes a first handle positioned in the first grip segment and a second handle positioned in the second grip segment and spaced apart from the first handle along a longitudinal axis of the apparatus, the first handle and the second handle oriented at an angle of greater than ninety degrees relative to the longitudinal axis of the assembly.

5. The apparatus of claim 4, wherein the grip section includes a third pair of handles, third pair of handles including a first handle positioned in the first grip segment and a second handle positioned in the second grip segment and spaced apart from the first handle of the third pair of handles along a longitudinal axis of the apparatus, the first handle and the second handle of the third pair of handles oriented at an angle of about ninety degrees relative to the longitudinal axis of the assembly.

6. The apparatus of claim 2, wherein the first pair of handles is offset relative to the second pair of handles in a height-wise direction of the grip section.

7. The apparatus of claim 1, wherein the first sleeve and the second sleeve are aligned along the longitudinal axis of the apparatus.

8. The apparatus of claim 1, wherein the platform defines a surface for coupling a pad spacer to the apparatus.

9. The apparatus of claim 1, wherein the grip section includes first and second indents between the first grip segment and the second grip segment, wherein first indent is at least partially defined by a third one of the side surfaces of the platform, and wherein the second indent is at least partially defined by a fourth one of the side surfaces of the platform positioned opposite the third one of the side surfaces of the platform, whereby the grip section defines a generally hour-glass shape.

10. The apparatus of claim 1, wherein the grip section includes a first pair of handles and a second pair of handles;

wherein the first pair of handles includes a first handle positioned in the first grip segment and a second handle positioned in the second grip segment, and wherein a longitudinal axis of the first handle and a longitudinal axis of the second handle are arranged in a first plane;

wherein the second pair of handles includes a third handle positioned in the first grip segment and a fourth handle positioned in the second grip segment, and wherein a longitudinal axis of the third handle and a longitudinal axis of the fourth handle are arranged in a second plane; and wherein the first plane is offset relative to the second plane in a height-wise direction of the grip section, whereby the first pair of handles is offset relative to the second pair of handles within the grip section.

11. The apparatus of claim 10, wherein the longitudinal axis of the apparatus is arranged in the second plane, whereby the first pair of handles is further offset relative to the longitudinal axis of the apparatus in the height-wise direction of the grip section.

12. An assembly for use in performing an exercise movement, the assembly comprising:

a weight bar including:

a grip section having at least one pair of handles;

a first sleeve coupled to a first end of the grip section; and a second sleeve coupled to a second end of the grip section, which is opposite the first end;

wherein each of the first and second sleeves is structured to receive one or more weight plates; and wherein the grip section includes a first grip segment, a second grip segment, and a platform positioned between the first grip segment and the second grip segment; wherein the platform defines a box-shape having a top surface, a bottom surface, and side surfaces; and wherein the top surface and the bottom surface of the platform each defines a rectangular shape, and wherein a first one of said side surfaces of the platform forms an inner wall of the first grip segment and a second one of said side surfaces of the platform forms an inner wall of the second grip segment; and an apparatus configured to couple to the weight bar to limit movement of the weight bar relative to a user performing the exercise movement, the apparatus including:

a pad; and a strap attached to the pad, wherein the strap is configured to couple the pad to the weight bar at the platform;

whereby the pad provides a spacing between the weight bar and the user performing the exercise movement with the weight bar.

13. The assembly of claim 12, wherein the platform of the weight bar defines a generally flat surface, and wherein the apparatus is configured to couple to the weight bar at the flat surface of the platform.

14. An apparatus for use in performing an exercise movement, the apparatus comprising:

a grip section including at least one pair of handles;

a first sleeve disposed along a longitudinal axis of the apparatus, the first sleeve coupled to a first end of the grip section; and a second sleeve disposed along the longitudinal axis of the apparatus, the second sleeve coupled to a second end of the grip section, which is opposite the first end, each of the first and second sleeves structured to receive one or more weight plates;

wherein the grip section includes a first grip segment, a second grip segment, and a platform positioned between the first grip segment and the second grip segment; and wherein the at least one pair of handles includes a first pair of handles having a first handle positioned in the first grip segment and a second handle positioned in the second grip segment, the first handle and the second handle offset relative to the longitudinal axis of the apparatus in a height-wise direction of the grip section.

15. The apparatus of claim 14, wherein the platform defines a box-shape having a flat top surface and a flat bottom surface, and wherein the flat top surface and the flat bottom surface each have a generally rectangular shape.

16. The apparatus of claim 15, wherein the grip section includes first and second indents between the first grip segment and the second grip segment, wherein the first indent is defined by a first sidewall of the platform, and wherein the second indent is defined by a second sidewall of the platform positioned opposite the first sidewall of the platform, whereby the grip section defines a generally hour-glass shape.

* * * * *